US006895839B1

(12) United States Patent
Hsien

(10) Patent No.: US 6,895,839 B1
(45) Date of Patent: May 24, 2005

(54) CONTROL MECHANISM FOR CONTROLLING HEAD OF A BOX END WRENCH

(76) Inventor: Chih-Ching Hsien, No. 367, Pei-Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/910,288

(22) Filed: Aug. 4, 2004

(51) Int. Cl.[7] ..... B25B 23/16

(52) U.S. Cl. ..... 81/177.8; 81/177.7; 81/177.9; 403/93

(58) Field of Search ..... 81/177.8, 177.7, 81/177.85, 177.9, 58, 58.1, 58.3, 60; 403/93

(56) References Cited

U.S. PATENT DOCUMENTS 4,901,608 A * 2/1990 Shieh ..... 81/177.8

6,745,650 B1 * 6/2004 Chang ..... 81/177.8

* cited by examiner

*Primary Examiner*—Joseph J. Hail, III
*Assistant Examiner*—Alvin J Grant

(57) ABSTRACT

A wrench includes a box end head with a protrusion extending therefrom and the protrusion has an inclined surface defined in a distal end thereof and a first engaging area defined in a part of the inclined surface. The protrusion is pivotably connected to the handle which has a transverse hole and a control member is movably received in the transverse hole along a longitudinal direction of the transverse hole. The control member has a second engaging area removably engaged with the first engaging area along the longitudinal direction of the transverse hole. The head can be pivoted relative to the handle when the second engaging area is moved away from the first engaging area by pushing the control member.

6 Claims, 10 Drawing Sheets

CONTROL MECHANISM FOR CONTROLLING HEAD OF A BOX END WRENCH

FIELD OF THE INVENTION

The present invention relates to a box end wrench wherein the box end is controlled by a control mechanism so as to be positioned at a desired angle.

BACKGROUND OF THE INVENTION

A conventional ratchet tool having an angle-adjustable head is disclosed in U.S. Pat. No. 6,216,567 and generally includes a pawl biased by a first spring so as to limit the pivotable movement of the head and a control member biased by a second spring such that when pushing the control member, the pawl is disengaged from the head which is able to be pivoted. Another conventional pivotable wrench is disclosed in U.S. Pat. No. 6,148,698 and generally includes two toothed lugs on the head and a control mechanism is received in a transverse passage in the handle. The control mechanism includes a shaft with two toothed sections for being matched with the two toothed lugs. Nevertheless, both of the two inventions include multiple number of tiny parts which make the assembly processes to be complicated and time consuming. Besides, many holes and recesses with stepped surfaces have to be drilled in the head or the handle so as to receive the parts and the head or the handle has only limited area for the drilling.

The present invention intends to provide a control mechanism that controls the position of the pivotable head relative to the head by a simple and reliable mechanism.

SUMMARY OF THE INVENTION

The present invention relates to a wrench that comprises a head with a clamping space defined therein and a protrusion extends from the head. The protrusion has an inclined surface defined in a distal end thereof and a first engaging area is defined in a part of the inclined surface. A handle has two lugs between which the protrusion is pivotably connected. A transverse hole is defined in the handle and communicates with the receiving space for receiving the protrusion. The transverse hole includes a section having a polygonal inner periphery. A control member is movably received in the transverse hole along a longitudinal direction of the transverse hole and has a second engaging area which is removably engaged with the first engaging area along the longitudinal direction of the transverse hole. The control member includes a polygonal portion which is movably received in the polygonal inner periphery of the transverse hole. The control member has an enlarged portion and the inclined surface of the protrusion contacts the enlarged portion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
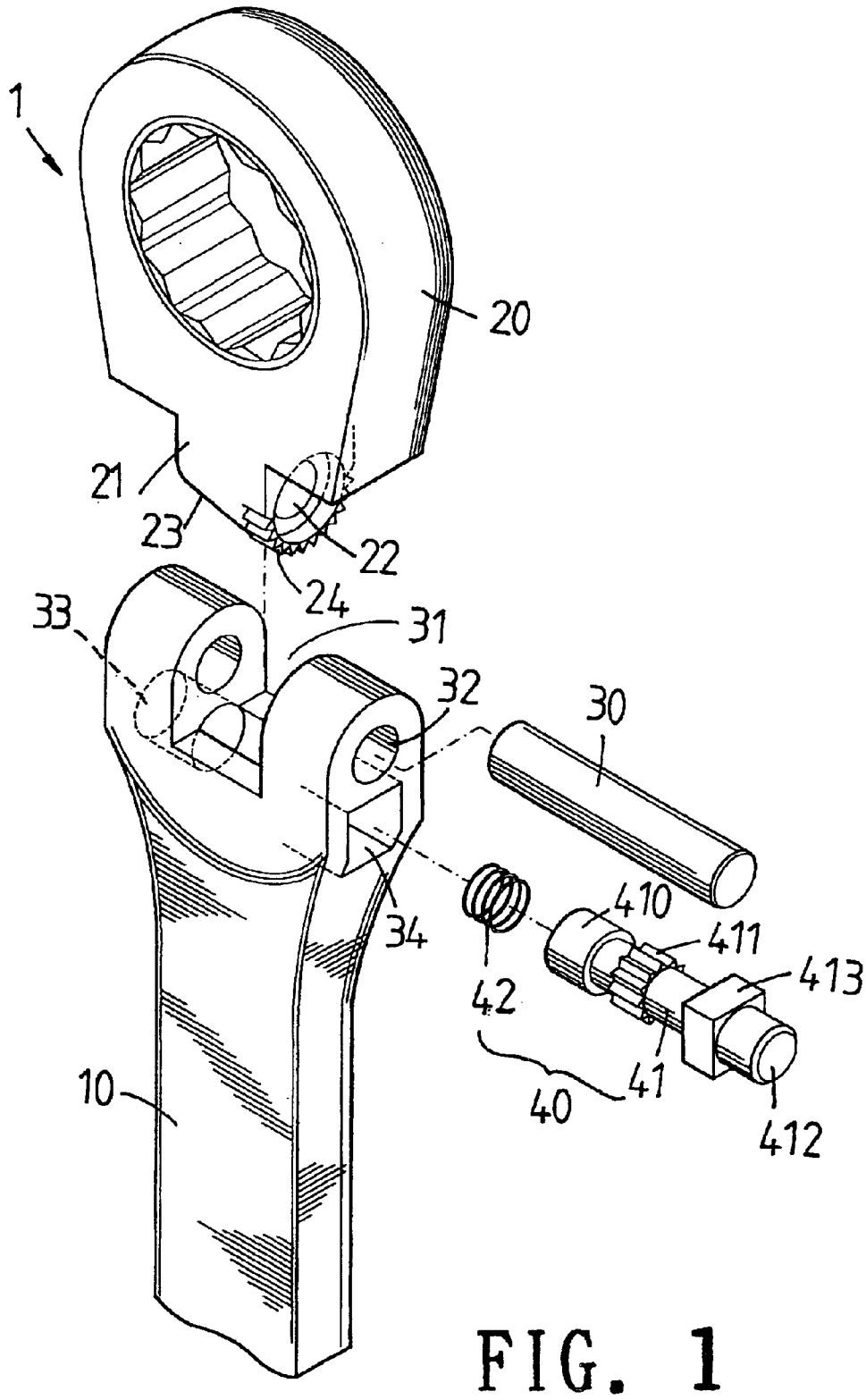
FIG. 1 is an exploded view to show the control mechanism and the wrench of the present invention.
Figure 2:
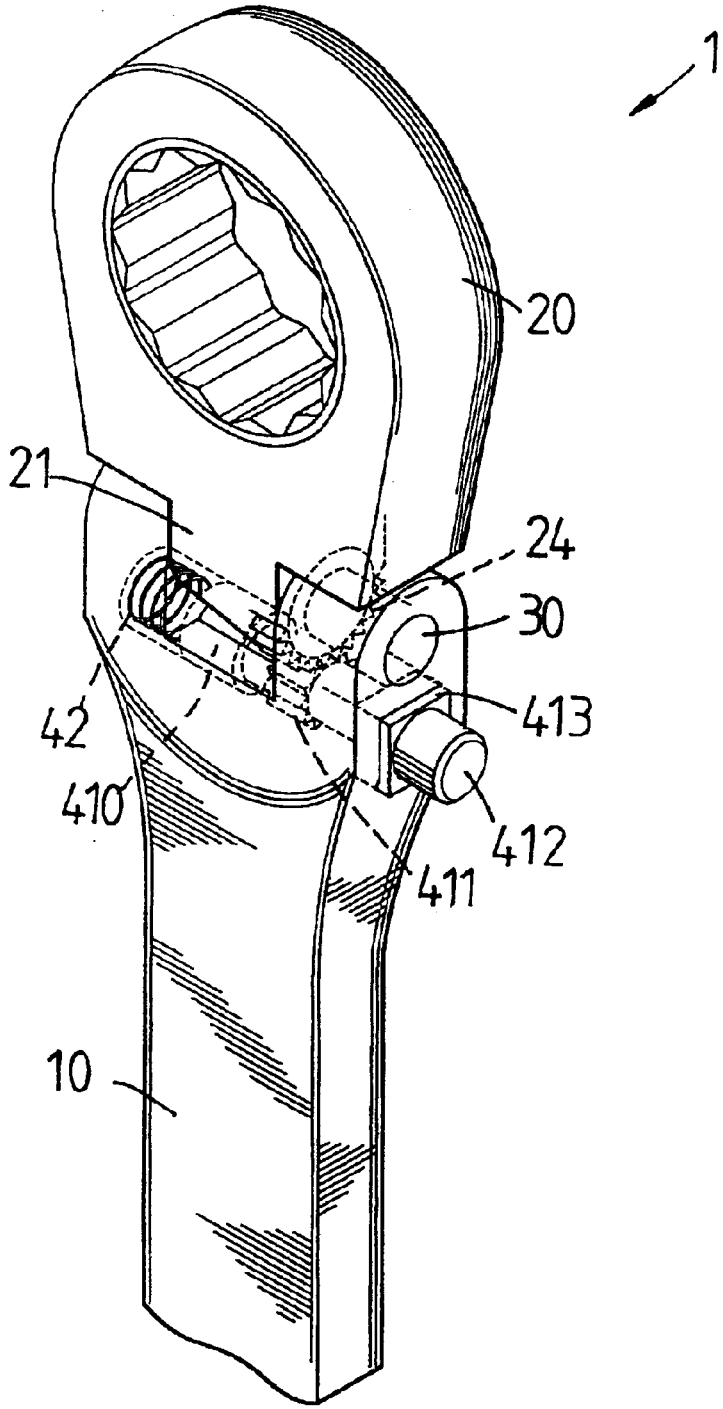
FIG. 2 is a perspective view to show the wrench with the control mechanism of the present invention.
Figure 4:
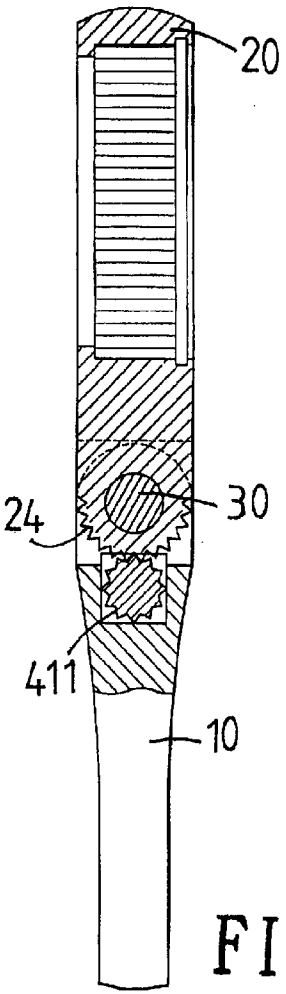
FIG. 4 is a side cross sectional view to show the wrench with the control mechanism of the present invention.
Figure 3:
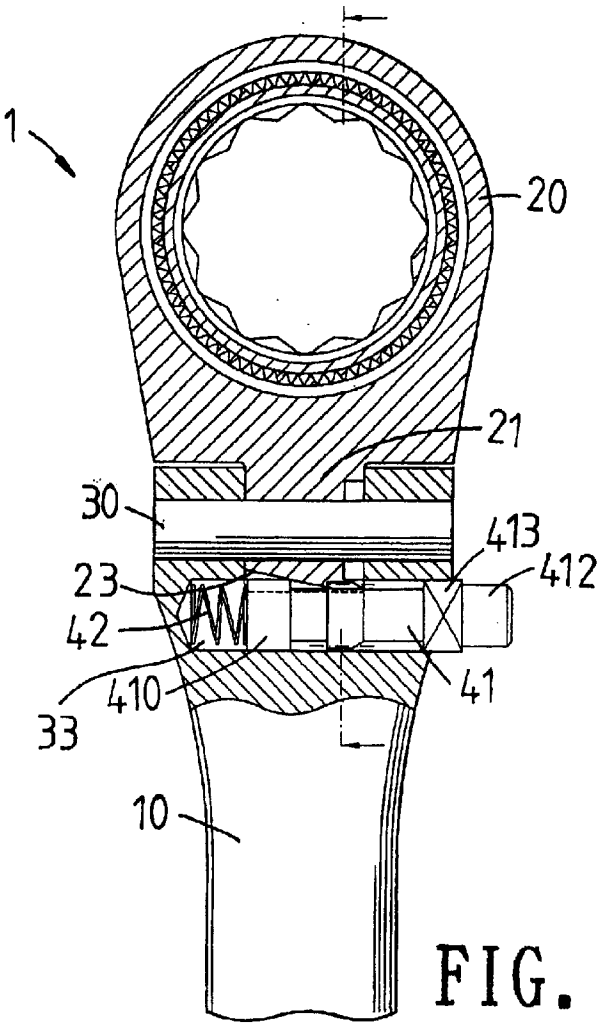
FIG. 3 is a cross sectional view to show the wrench with the control mechanism of the present invention.

Referring to FIGS. 1 to 4, the wrench of the present invention comprises a head 20 with a clamping space defined therein and a protr usion 21 extends from the head 20. The protrusion 21 has an inclined surface 23 defined in a distal end thereof and a first engaging area 24 including a plurality of teeth is defined in a part of the inclined surface 23.

A handle 10 has two lugs extending from an end thereof and a receiving space 31 is defined between the two lugs. The protrusion 21 is pivotably received in the receiving space 31 by extending a shaft 30 through the two respective holes 32 defined through the two lugs and the hole 22 defined through the protrusion 21. A transverse hole 33 is defined in the handle 10 and communicates with the receiving space 31. The transverse hole 33 includes a section that has a polygonal inner periphery 34.

A control mechanism 40 includes a control member 41 which is movably received in the transverse hole 33 along a longitudinal direction of the transverse hole 33 and a spring 42 is received in an inner end of the transverse hole 22 so as to bias a distal end of the control member 41. The control member 41 has a second engaging area 411 defined in an outer periphery thereof, the second engaging area 411 removably engaged with the first engaging area 24 along the longitudinal direction of the transverse hole 33. The control member 41 includes a polygonal portion 413 which is movably received in the polygonal inner periphery 34 of the transverse hole 33 so that the control member 41 can only moved in the transverse hole 33 and cannot rotate. The control member 41 has an enlarged portion 410 and the inclined surface 23 of the protrusion 21 contacts the enlarged portion 410. The spring 42 keeps the polygonal portion 413 to be received in the polygonal inner periphery 34 of the transverse hole 33. A push end 412 of the control member 41 extends out from the transverse hole 33.

Figure 6:
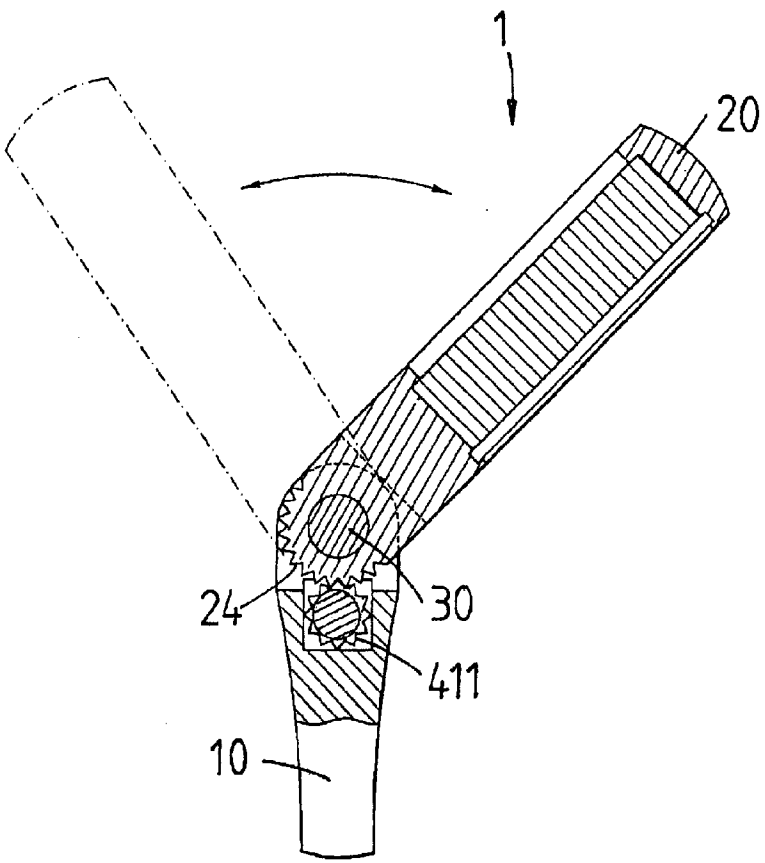
FIG. 6 shows the head can be pivoted while the control member is pushed.
Figure 5:
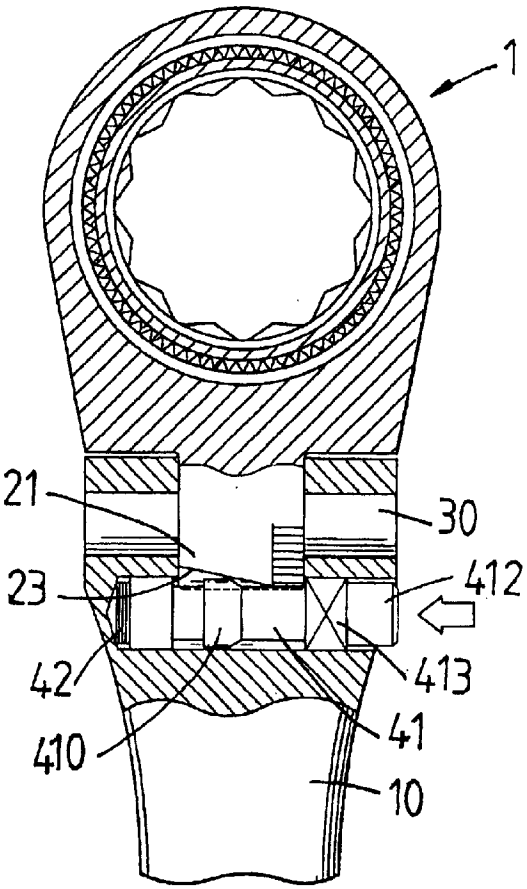
FIG. 5 shows the control member is pushed and the first and second engaging areas are separated from each other.
Figure 8:
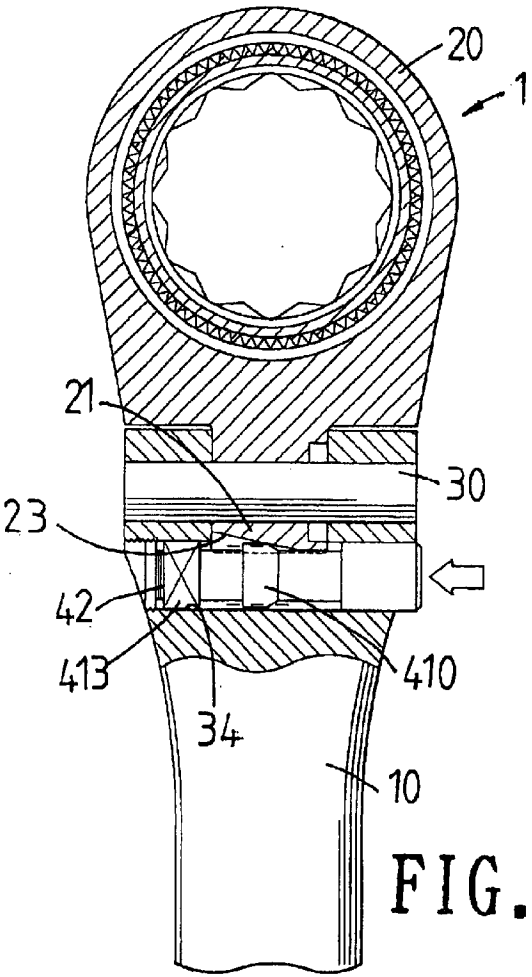
FIG. 8 shows that the control member in FIG. 7 is pushed.
Figure 7:
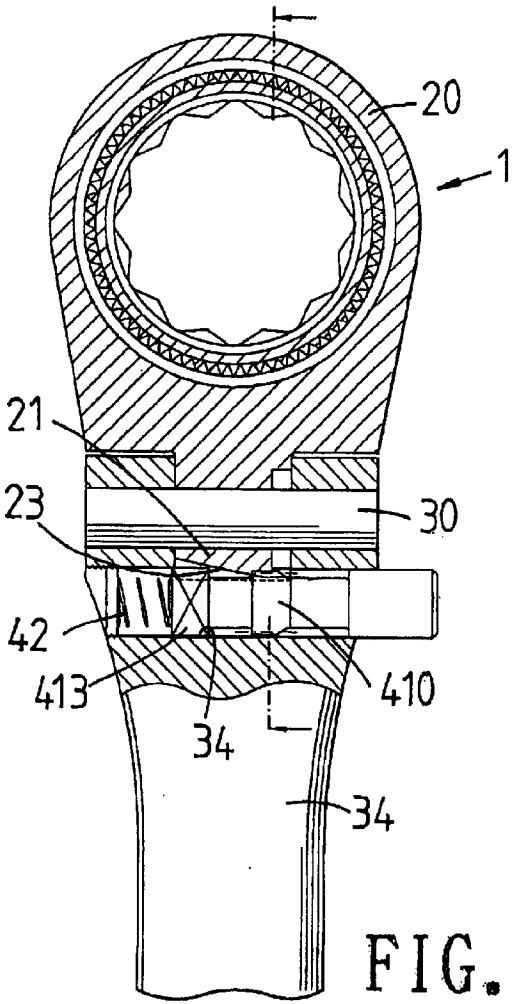
FIG. 7 is a cross sectional view to show another embodiment of the control member.
Figure 10:
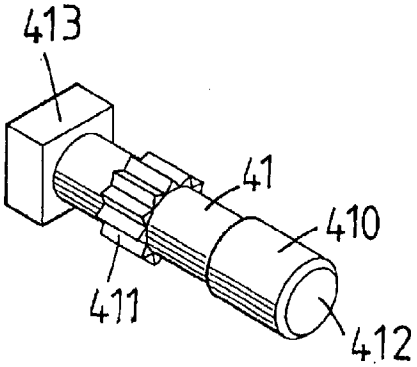
FIG. 10 shows the control member in FIG. 7.
Figure 9:
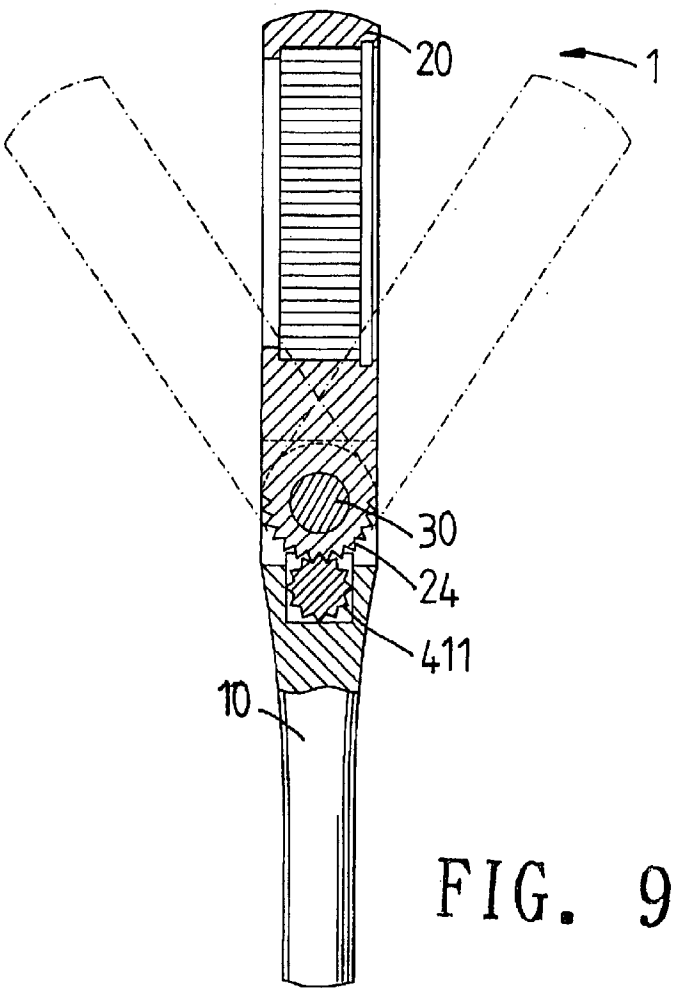
FIG. 9 shows the head can be pivoted while the control member in FIG. 7 is pushed.
Figure 12:
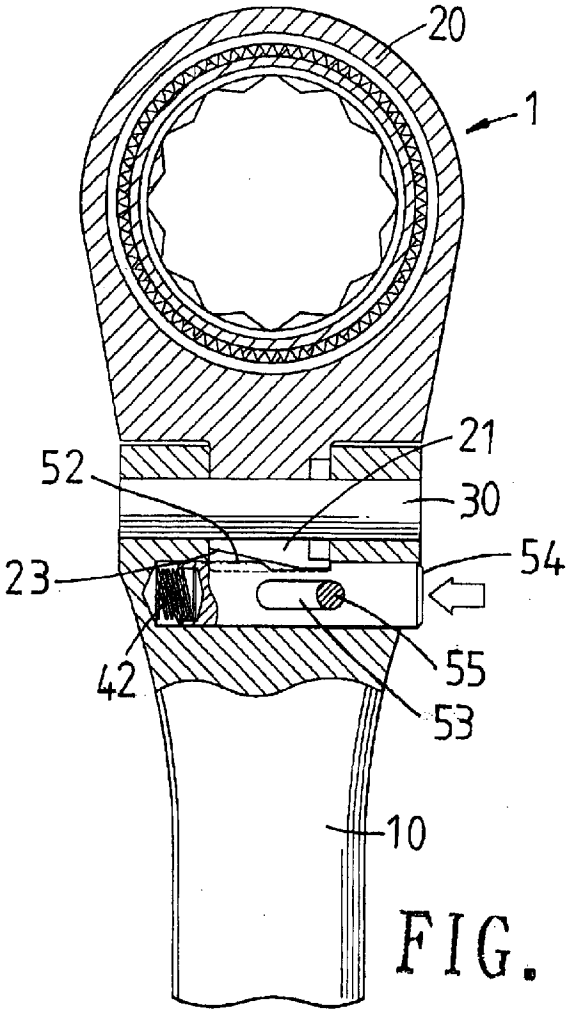
FIG. 12 shows that the control member in FIG. 11 is pushed.
Figure 11:
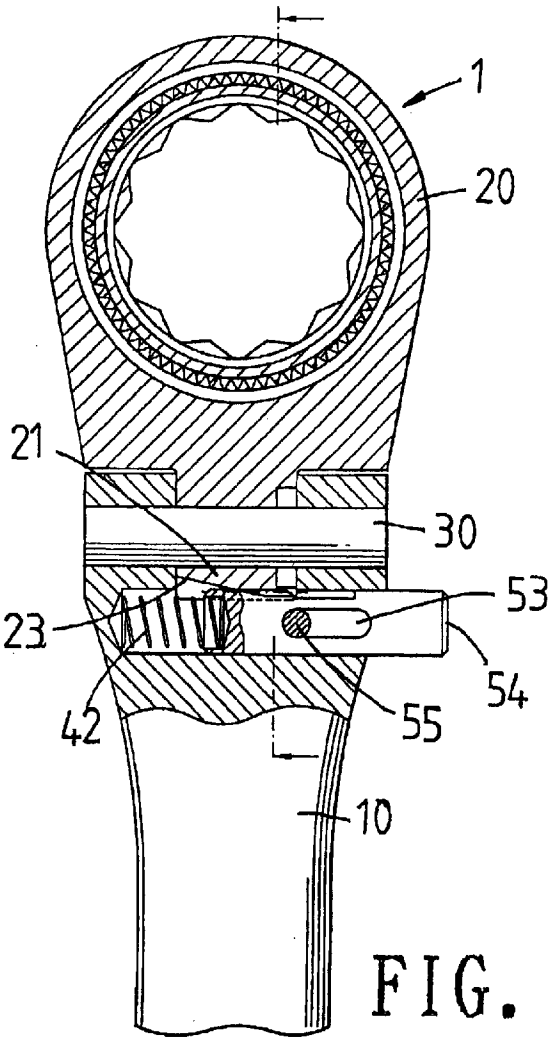
FIG. 11 is a cross sectional view to show yet another embodiment of the control member.
Figure 14:
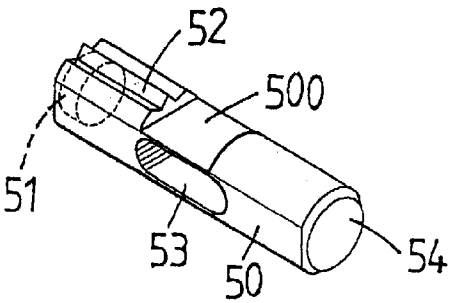
FIG. 14 shows the control member in FIG. 11.
Figure 13:
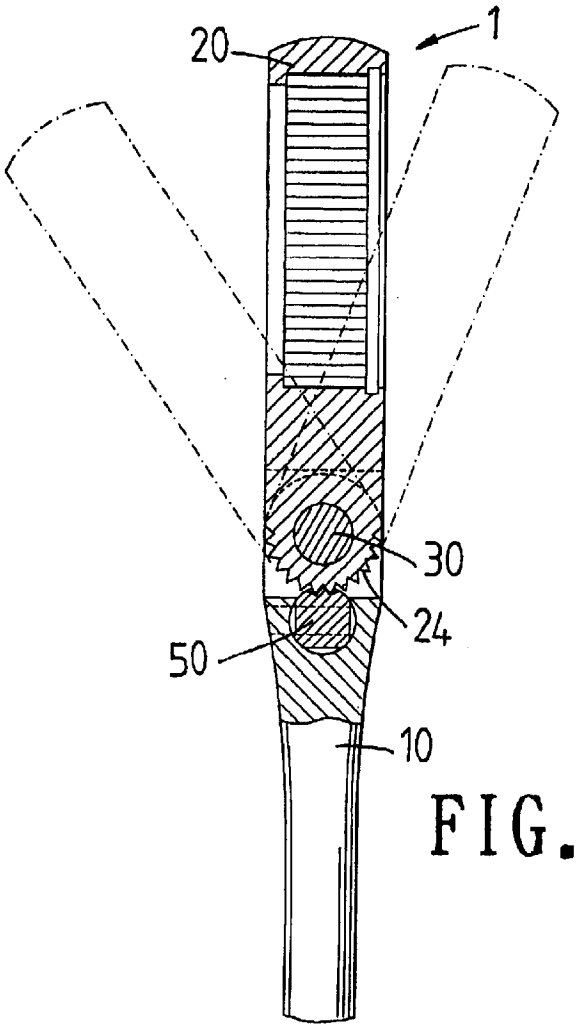
FIG. 13 shows the head can be pivoted while the control member in FIG. 11 is pushed.

As shown in FIGS. 5 and 6, when the user pushes the push end 412 of the control member 41 to compress the spring 42, the second engaging area 411 is shifted and disengaged from the first engaging area 24, and the enlarged portion 410 is also shifted and removed from the inclined surface 23 of the protrusion 21. The head 20 is therefore pivotable relative to the handle 10. When the head 20 is pivoted to a desired angle, the control member 41 is released, the second engaging area 411 is engaged with the first engaging area 24 again to position the head 20. It is noted that the structure of the control mechanism is so simple and comprises only two parts. No complicated holes need to be drilled in the handle 10 or the head 20. The way of operation of the control member 41 is easy.

Referring to FIGS. 7 to 10, another embodiment of the control member 41 is similar to the control member 41 in FIG. 1, the only difference is that the positions of the enlarged portion 410 and the polygonal portion 413 are switched with each other, and the positions of the polygonal inner periphery 34 of the transverse hole 33 is located at the inner end of the transverse hole 33. The spring 42 biases the end of the polygonal portion 413.

Yet another embodiment of the control member 50 is disclosed in FIGS. 11 to 14, the control member 50 has a notch 51 is defined in an end of the control member 50 and an end of the spring 42 is received in the notch 51. The second engaging area 52 is defined in an outer periphery thereof and a recess 500 is defined in the outer periphery of the control member 50 so that the inclined surface 23 of the protrusion 21 contacts a stepped shoulder defined by the recess 500. A slot 53 is defined through a body of the control member 41 and a pin 55 fixed to the head 20 extends through the slot 53 so that the control member 50 cannot rotate. The push end 54 extends from the handle 10. The operation of the control member 50 is the same as the embodiment in FIGS. 1–6.

Figure 16:
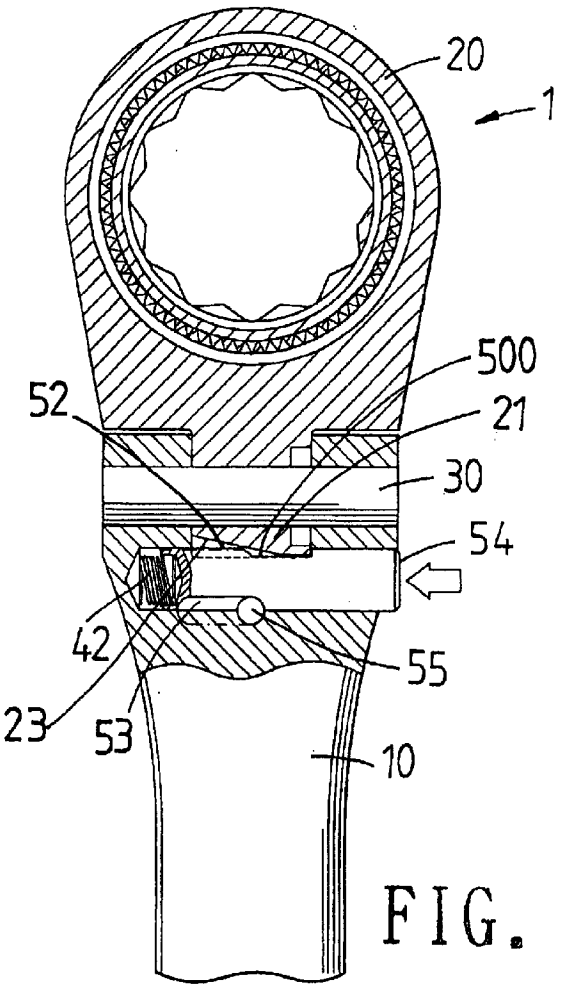
FIG. 16 shows that the control member in FIG. 15 is pushed.
Figure 15:
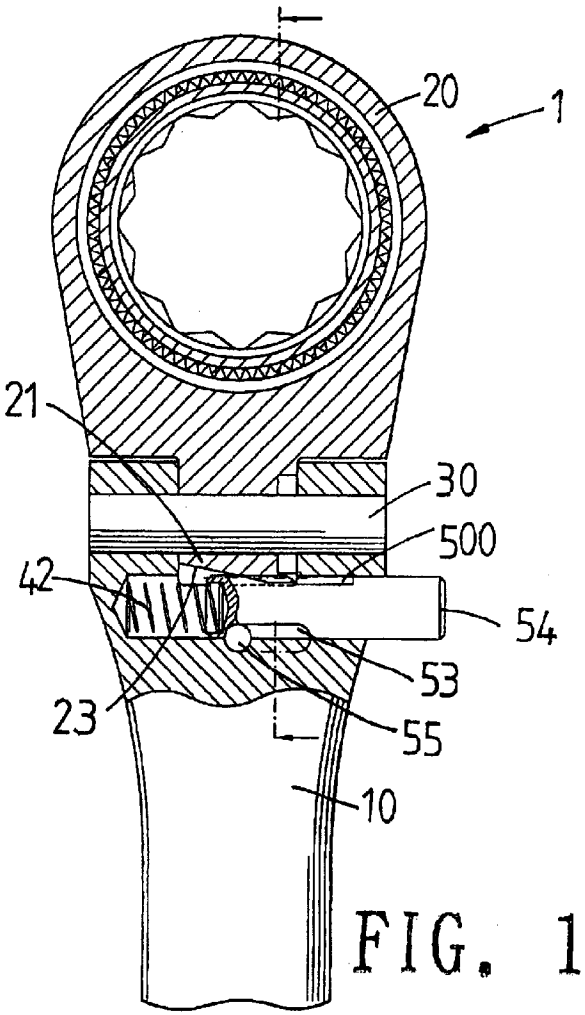
FIG. 15 is a cross sectional view to show a further embodiment of the control member.
Figure 18:
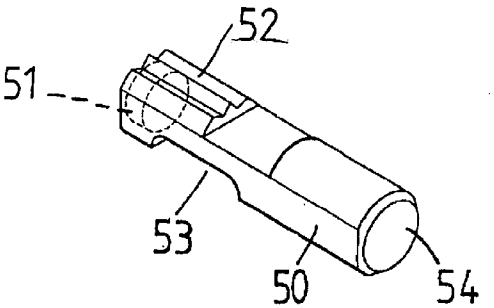
FIG. 18 shows the control member in FIG. 15.
Figure 17:
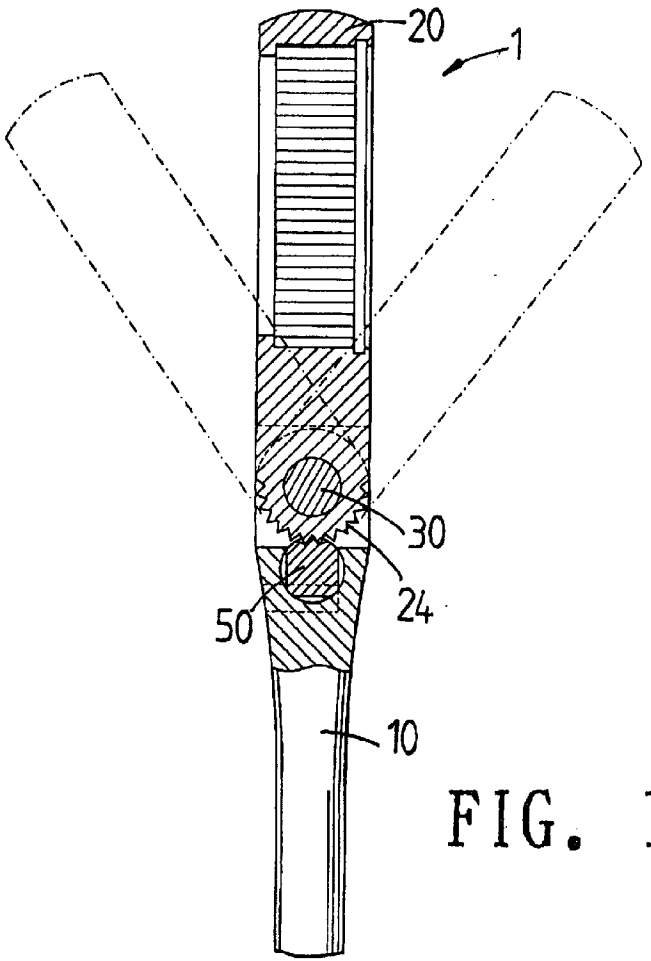
FIG. 17 shows the head can be pivoted while the control member in FIG. 15 is pushed.

The control member 50 can be made as disclosed in FIG. 18 wherein the slot 53 is defined in an outer periphery of the control member 41. The operation of the control member 50 is the same as the first embodiment and is disclosed in FIGS. 15 to 17.

While we have shown and described the embodiment in accordance with the present invention, it should be clear to those skilled in the art that further embodiments may be made without departing from the scope of the present invention.

What is claimed is:

1. A wrench comprising:

a head with a clamping space defined therein and a protrusion extending from the head, the protrusion having an inclined surface defined in a distal end thereof and a first engaging area defined in a part of the inclined surface;

a handle having two lugs extending from an end thereof and a receiving space defined between the two lugs, the protrusion pivotably received in the receiving space, a transverse hole defined in the handle and communicating with the receiving space, the transverse hole including a section that has a polygonal inner periphery, and a control member movably received in the transverse hole along a longitudinal direction of the transverse hole and having a second engaging area defined in an outer periphery thereof, the second engaging area removably engaged with the first engaging area along the longitudinal direction of the transverse hole, the control member including a polygonal portion which is movably received in the polygonal inner periphery of the transverse hole, the control member having an enlarged portion and the inclined surface of the protrusion contacting the enlarged portion.

2. The wrench as claimed in claim 1, wherein a spring is received in an inner end of the transverse hole and biases a distal end of the control member.

3. A wrench comprising:

a head with a clamping space defined therein and a protrusion extending from the head, the protrusion having an inclined surface defined in a distal end thereof and a first engaging area defined in a part of the inclined surface;

a handle having two lugs extending from an end thereof and a receiving space defined between the two lugs, the protrusion pivotably received in the receiving space, a transverse hole defined in the handle and communicating with the receiving space, the transverse hole including a section that has a polygonal inner periphery, and a control member movably received in the transverse hole along a longitudinal direction of the transverse hole and having a second engaging area defined in an outer periphery thereof, the second engaging area removably engaged with the first engaging area along the longitudinal direction of the transverse hole, a recess defined in the outer periphery of the control member and a slot defined in the control member, a pin fixed to the head and extending through the slot, the inclined surface of the protrusion contacting a stepped shoulder defined by the recess.

4. The wrench as claimed in claim 3, wherein a notch is defined in an end of the control member and an end of the spring is received in the notch.

5. The wrench as claimed in claim 3, wherein the slot is defined through a body of the control member.

6. The wrench as claimed in claim 3, wherein the slot is defined in an outer periphery of the control member.

* * * * *